US006955595B2

(12) United States Patent
Kim

(10) Patent No.: US 6,955,595 B2
(45) Date of Patent: Oct. 18, 2005

(54) CLEAN ROOM SYSTEM

(75) Inventor: Dong-Han Kim, Gyeongsangbuk-Do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/868,939

(22) Filed: Jun. 17, 2004

(65) Prior Publication Data

US 2004/0266330 A1 Dec. 30, 2004

(30) Foreign Application Priority Data

Jun. 28, 2003 (KR) ..... 10-2003-0042960

(51) Int. Cl.[7] ..... B01L 1/04

(52) U.S. Cl. ..... 454/187; 414/935

(58) Field of Search ..... 455/187; 414/935; 55/385.2

*Primary Examiner*—Derek S. Boles
(74) *Attorney, Agent, or Firm*—Morgan, Lewis & Bockius LLP

(57) ABSTRACT

A clean room system is provided. The clean room includes a plurality of multi-level clean rooms and an air passage. The plurality of multi-level clean rooms has at least a lower clean room and an upper clean room above the lower clean room. The air passage permits air flow between the upper clean room and the lower clean room and smooths the air flow.

27 Claims, 7 Drawing Sheets

CLEAN ROOM SYSTEM

The present application claims the benefit of Korean Patent Application No. 2003-42960 filed in Korea on Jun. 28, 2003, which is hereby incorporated by reference.

BACKGROUND OF THE INVENTION

1. Field of the Invention

The present invention relates to a space for fabricating a semiconductor device or a liquid crystal display device, and more particularly, to a structure of a clean room system having improved uniformity of air flow in a substantially vertical direction within a fabrication space.

2. Description of the Related Art

Development of TFT-LCD technology and its application have been accelerated with increased size and resolution. Presently, growth of productivity and low price are important factors for a product. To achieve this, cooperation between manufacturers, related material industries and fabrication equipment providers is required for simplification of the fabrication process and improvement in yield.

The fabrication process of a TFT-LCD panel can be divided into a TFT array process for forming switching devices to apply a signal of a pixel unit, a color filter process for forming R, G and B color filters to implement colors, and a liquid crystal process for forming a liquid crystal layer between a thin film transistor substrate and a color filter substrate. The liquid crystal display device formed by such a process can easily become defective due to fine dust or particle generated during the process. As a result, preventing contamination is crucial to reduce cost, to achieve high yield, and to efficiently produce a liquid crystal display device. Staff, equipment, facility (including clean room), and chemicals are a major cause of fine particle contamination. Especially, particles coming from staff and the clean facility are major contaminants. Thus, an extremely clean fabrication space (referred to as a 'clean room', hereinafter) is required for manufacturing a liquid crystal display device.

FIG. 1 illustrates the structure of a related art clean room system having three stories. As shown in FIG. 1, the three-story clean room system 100 includes a clean room 10 in which a fabrication process is substantially performed, lower and upper spaces (a and b) provided at upper and lower levels of the clean room 10, and dry coils 18*a* and 18*b* positioned at both sides of the clean room 10 and working as an air flow ascending passage. Equipment (for example, deposition equipment or etching equipment) for fabricating a liquid crystal are disposed in the clean room 10, and a fan filter unit 15 for supplying an air stream into the clean room 10 is provided at the ceiling of the clean room 10.

The related art clean room system 100 constructed as described above maintains cleanliness through independent air circulation in the clean room disposed in each floor. Namely, when an air stream is supplied from the lower space (a) of the first clean room 10*a* to the upper space (b) of the first clean room 10*a*, the air stream passes through the fan filter unit 15 disposed at the upper side of the first clean room 10*a* to form a vertical air stream inside the first clean room 10*a*. The vertical air stream comes into the lower space (a) of the clean room 10*a* after passing through the bottom plate 17 of the first clean room 10*a*, and then, ascends to the upper space (b) of the first clean room 10*a* through the dry coils 18*a* and 18*b* formed at both sides of the first clean room 10*a*. The air stream that has come in the upper space (b) moves into the first clean room 10*a* again through the fan filter unit 15 and forms a vertical air stream therein, and then, is discharged to the lower space (a) of the clean room 10*a*. Air stream circulation of the second and third clean rooms 10*b* and 10*c* is made in the same manner as in the first room 10*a*.

The related art clean room system 100 repeats air flow circulation by raising an air stream of the lower space (a) of the clean room 10 up to the upper space (b) through the dry coils 18*a* and 18*b* prepared at both sides of the clean room 10, thereby maintaining cleanliness.

However, in the clean room system 100, since the dry coils 18*a* and 18*b*, the passage of the air stream to the upper space (b) are disposed at both sides of the clean room 10, the air stream in the clean room 10 is not formed exactly vertically but inclined to the side. Thus, as shown in FIGS. 2A and 2B, since the air stream in the central portion of the clean room 10 is inclined to the side of the dry coils 18*a* and 18*b*, cleanliness cannot be properly maintained in the central portion of the clean room 10.

SUMMARY OF THE INVENTION

Accordingly, the present invention is directed to a clean room system that substantially obviates one or more of the problems due to limitations and disadvantages of the related art.

Therefore, one object of the present invention is to provide a clean room system capable of uniformly forming an air stream in a vertical direction in a clean room.

Another object of the present invention is to provide a clean room system capable of effectively utilizing a space.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, a clean room system comprises a plurality of multi-level clean rooms having at least a lower clean room and an upper clean room disposed above the lower clean room; and an air passage disposed to permit air flow between the upper clean room and the lower clean room and smoothing the air flow.

In another aspect, a clean room system comprises a plurality of multi-level clean rooms having at least a lower clean room and an upper clean room disposed above the lower clean room, each clean room having a working space, an upper space and a lower space at upper and lower portions thereof; at least one interlayer boundary plate formed between the lower space of the upper clean room and an upper space of the lower clean room; and a plurality of dry coils formed substantially at the interlayer boundary plate and to provide a passage through which air can flow from the lower space of the upper level clean room to the upper space of the lower level clean room.

In another aspect, a clean room system comprises a lower clean room of multi-level clean rooms, the lower clean room having upper and lower spaces respectively above and below a working space of the lower clean room; an upper clean room of multi-level clean rooms disposed above the lower clean room, the upper clean room having upper and lower spaces respectively above and below a working space of the upper clean room; an interlayer boundary plate disposed between the lower space of the upper clean room and an upper space of the lower level clean room; and a plurality of holes formed at the interlayer boundary plate to provide a passage through which air can flow from the lower space of the upper level clean room to the upper space of the lower level clean room.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
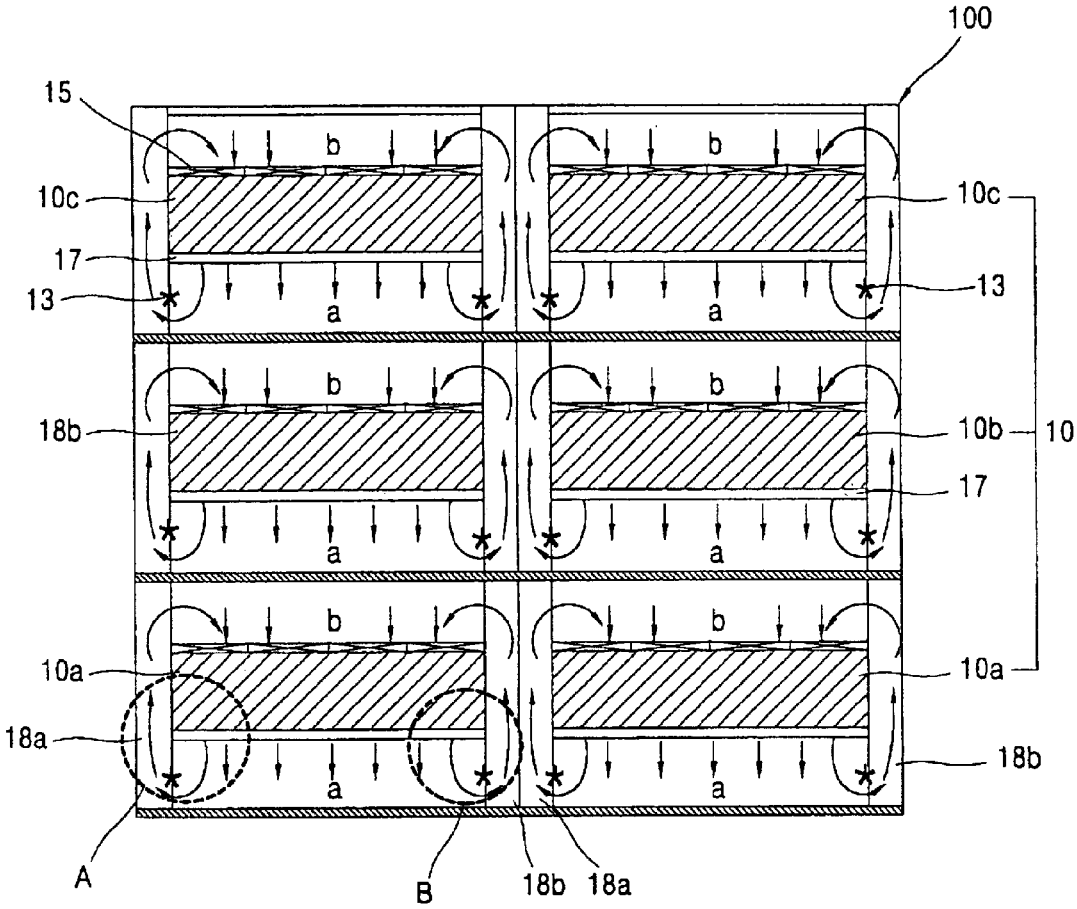
FIG. 1 RELATED ART
FIG. 1 is a sectional view showing the construction of a clean room system in accordance with a related art configuration.
Figure 2A:
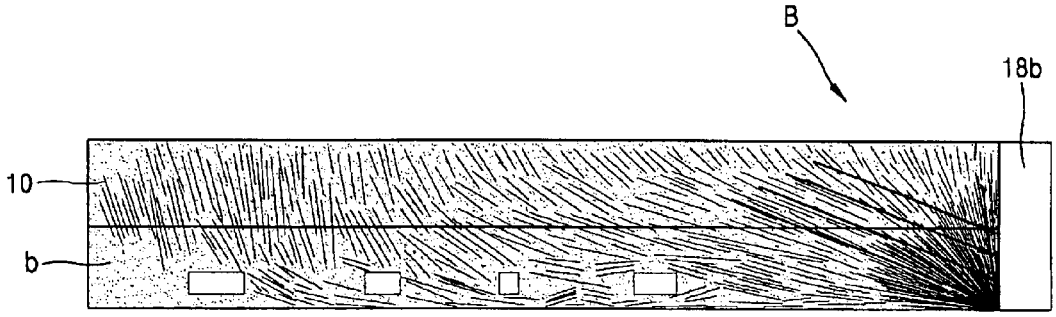
FIG. 2A RELATED ART
FIGS. 2A and 2B illustrate an air stream of one side and the other side of dry coils in accordance with the related art.
Figure 2B:
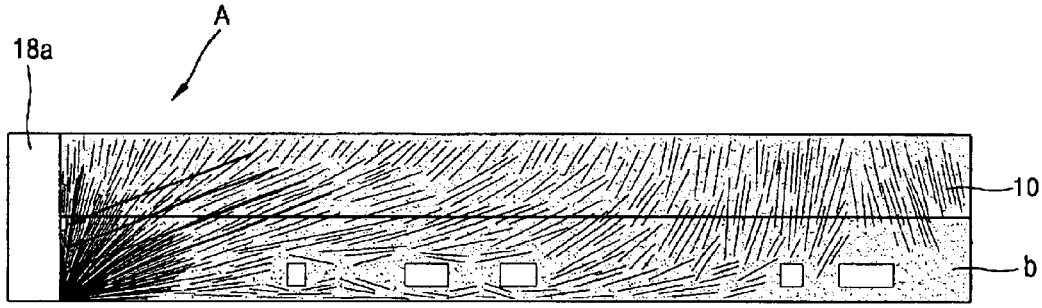
FIG. 2B RELATED ART
Figure 3:
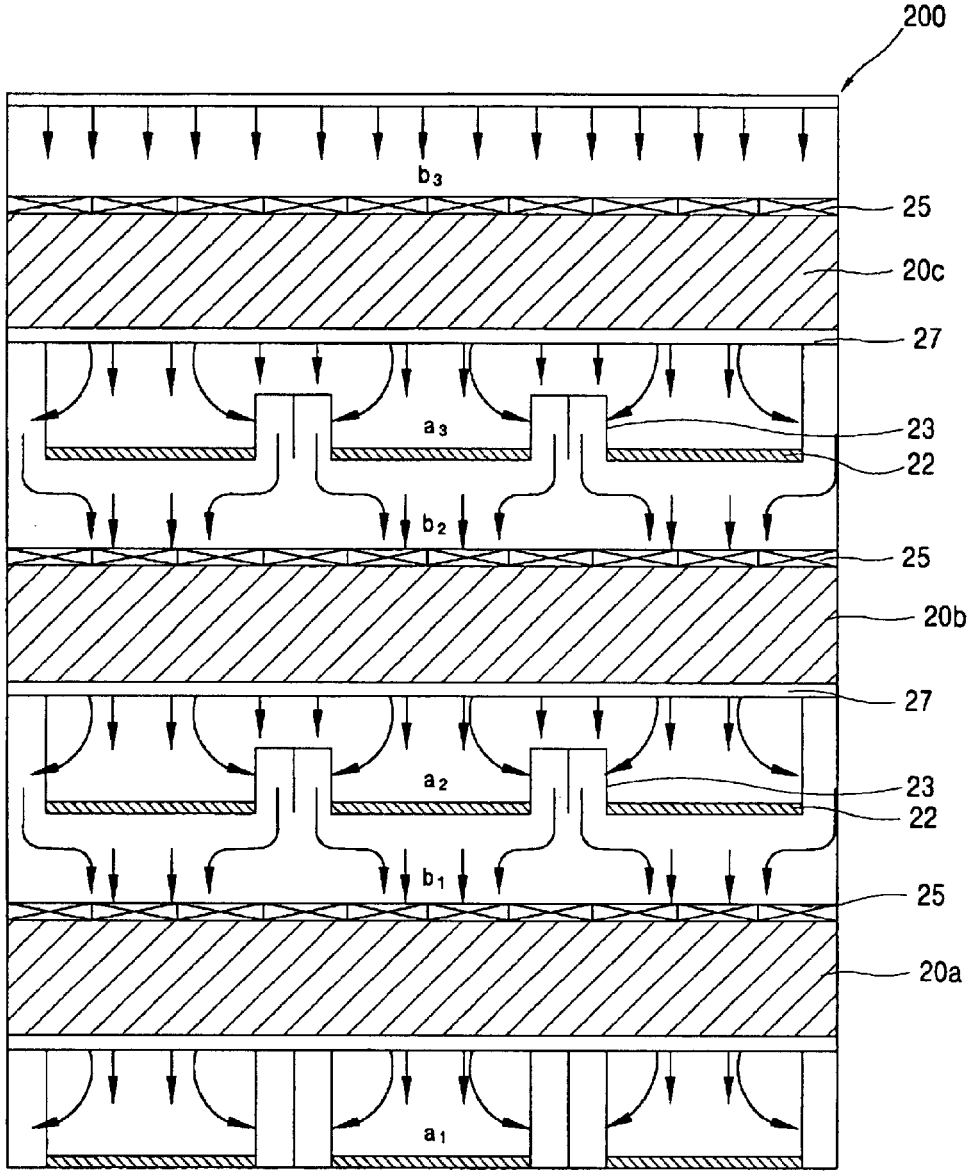
FIG. 3 is a sectional view showing the construction of a clean room system in accordance with the present invention.

FIG. 3 is a sectional view showing the construction of a clean room system in accordance with the present invention. The clean room system of FIG. 3 shows a three-story clean room system that is compared to the related art clean room system.

As shown in FIG. 3, a clean room system 200 includes a plurality of multi-level clean rooms 20*a*–20*c* in which a fabrication process such as a deposition or an etching is performed, lower and upper spaces a1–a3 and b1–b3 provided at lower and upper sides of the clean rooms 20*a*–20*c* and supplying and discharging an air stream; and a fan filter unit 25 disposed at the ceiling of each clean room 20*a*–20*c* and generating a vertical air stream between the upper clean room and the lower clean room.

Dry coils 23 are provided at the interlayer boundary plate 22 discriminating levels of the clean rooms to smoothly supply an air stream discharged from the upper clean room to the lower clean room and suitably controlling a temperature and a humidity of the air stream. The dry coils 23 are disposed at regular intervals at the interlayer boundary plate 22 to allow the air stream discharged from the upper clean room to uniformly pass through to be introduced into the lower clean room without being inclined.

The distance between the dry coils 23 can be variably set depending on the overall width of the clean room. Namely, on the assumption that the overall width of the clean room is 100 m, the dry coils can be formed at about 40 m intervals to make a flow of the air stream uniform. To make the air flow even more uniform, the dry coils can be formed more closely to each other. Since the dry coils 23 are installed in the interlayer boundary plate 22 between the clean rooms 20*a*, 20*b* and 20*c*, even if the number of dry coils is increased, the space for the clean rooms can be secured as it is. Instead of dry coils, holes can be uniformly disposed on the interlayer boundary plate 22. Namely, an interlayer air stream flow can be formed through the holes formed on the interlayer boundary plate 22.

Deposition equipment, exposing equipment and etching equipment are disposed in each clean room 20*a*–20*c* to perform depositing and etching processes. Also, the fan filter unit 25 is provided at the ceiling of each clean room 20*a*–20*c* to maintain cleanliness inside the clean room and to generate an air stream flow.

Figure 4:
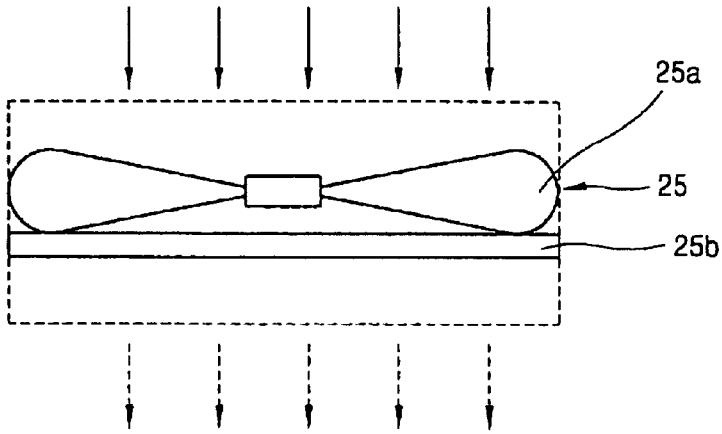
FIG. 4 is a schematic view showing a fan filter unit.

As shown in FIG. 4, the fan filter unit 25 includes a fan 25*a* and a filter 25*b* for filtering fine particles, such as dust. Air is drawn in by the rotation of the fan 25*a* and then fine particles, such as dust, in the air are filtered by rotation of the filter 25*b*. Then, the dust-free air is discharged to the lower level.

Figure 5:
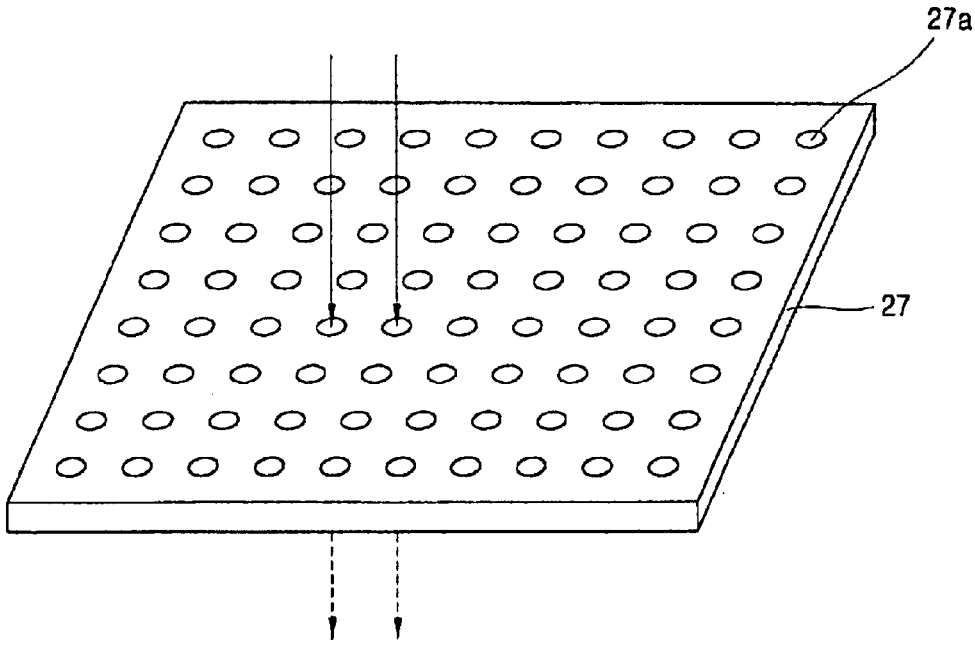
FIG. 5 illustrates the bottom plate of the clean room.

As shown in FIG. 5, the bottom plate 27 of each clean room 20*a*–20*c* includes through holes 27*a*, thereby allowing air inside the clean room to pass to the lower space of the clean room therethrough. The through holes 27*a* are formed in a uniform density on the entire bottom plate 27.

The clean room system 200 constructed as described maintains the cleanliness of the clean room through a non-circulation method that continuously receives fresh external air or through a circulation method that continuously circulates external air in the entire clean room. The non-circulation method uses 100% external air. Moreover, because the air coming from the lower clean room must be wholly discharged, an air stream discharge pipe is provided to discharge the air to outside the clean room system. Contrastingly, in the circulation method, when external air is put thereinto, the external air is discharged to the lower level through the hole, the fan filter unit or the dry coil formed at the interlayer boundary plate, and the discharged air is introduced again to the upper level. Through this process, the air stream is circulated. Accordingly, to raise the air that has been discharged to the upper level, a connection pipe for connecting the upper level and the lower level needs to be prepared additionally.

Figure 5A:
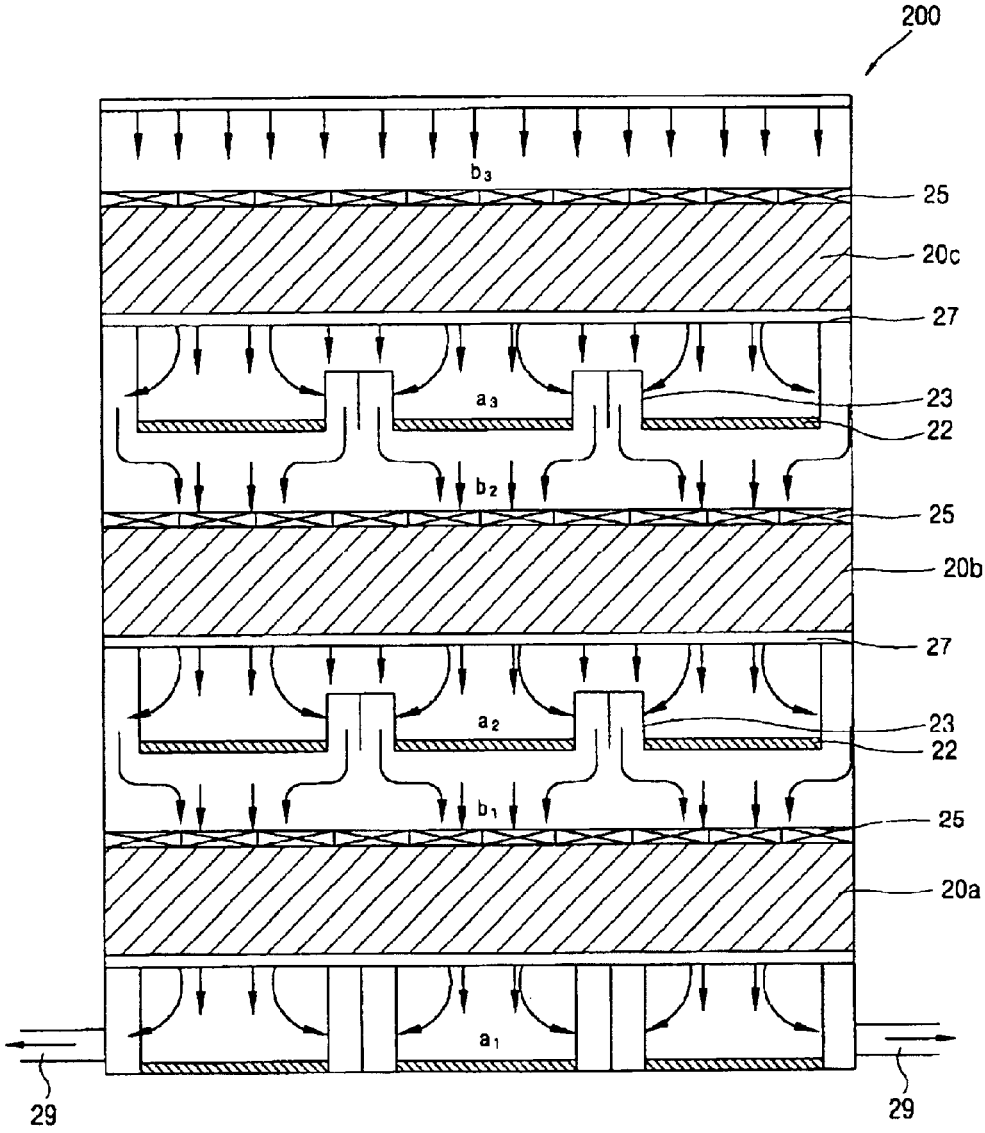
FIG. 5A is a sectional view showing an alternative construction of a clean room system in accordance with the present invention.

The clean room system 200 as shown in the alternative configuration of FIG. 5A in accordance with the present invention, when external air or air discharged from the lower level comes up into the upper space b3 of the third clean room 20*c* positioned at the uppermost level through a pipe 29, contamination particles are filtered through the fan filter unit 25 installed at the ceiling of the third clean room 20*c* and a vertical air stream is formed inside the third clean room 20*c*. The vertical air stream flows to the lower space a3 through the holes 27*a* of FIG. 5 formed on the bottom plate 27. The air stream discharged into the lower space a3 passes through the dry coil 23 and flows again to the upper space b2 of the second clean room 20*b*.

Figure 6:
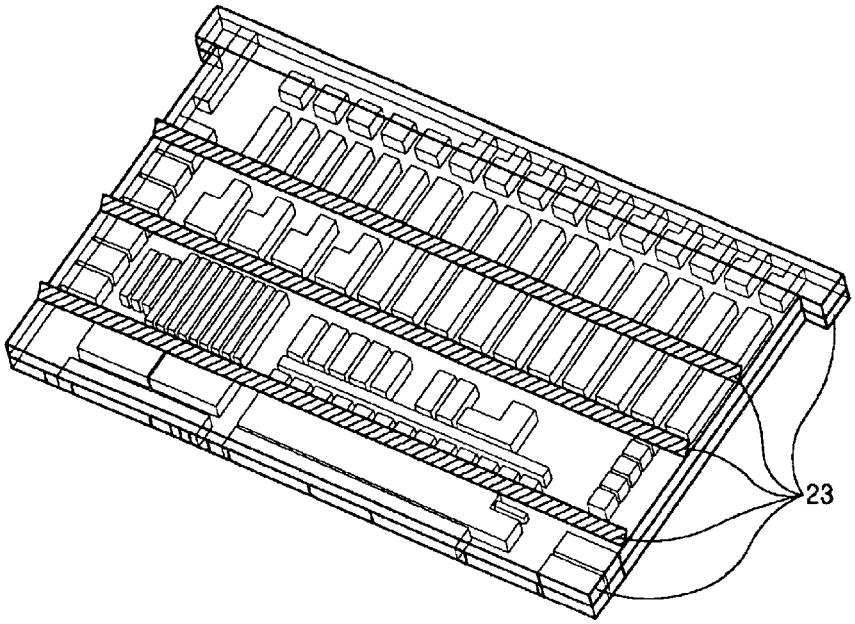
FIG. 6 is a perspective view showing the construction of the clean room system in accordance with the present invention.

At this time, as shown in FIG. 6, the dry coils 23 are disposed at regular intervals, and since the dry coils 23 are disposed at regular intervals at the interlayer boundary plate 22, the air stream coming into the lower space a3 of the third clean room 20*c* is not inclined to one side. Instead, a uniform vertical stream is maintained and flows to the upper space b2 of the second clean room 20*b*.

The air stream introduced into the upper space b2 of the second clean room 20*b* is drawn in by the fan filter unit 25 installed at the ceiling and comes into the second clean room 20*b* to form a uniform vertical air stream. The air stream then comes into the first clean room 20*a* after passing through the dry coil 23 formed at the interlayer boundary plate 22. The air stream that has come into the first clean room 20*a* is discharged to the lower space a1 of the first clean room 20*a* and forcibly exhausted through an external exhaust pipe (not shown) or introduced into the upper space b3 of the third clean room 20*c* through a connection pipe (not shown) provided at both external sides of the clean room system 200. The air stream introduced into the upper space b3 of the third clean room 20*c* repeatedly undergoes the above-described processes, thereby maintaining the interior of the clean room clean.

Figure 7:
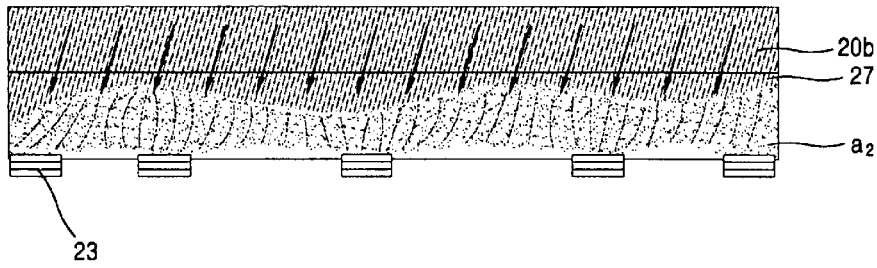
FIG. 7 illustrates an air stream flow in accordance with the present invention.

FIG. 7 illustrates a result of simulation of an air stream flow inside the clean rooms as performed through the above-described method. Specifically, it shows the air stream flow between the second clean room 20*b* and the second clean room lower space b2 of the clean room system 200.

As shown in FIG. 7, the vertical air stream flowing in the uniform direction is generated both at the center and at the sides in the second clean room 20*b*, passed through the lower space a2 of the second clean room and discharged through the dry coils 23. Since the dry coils 23 are disposed at regular intervals, the air stream is not inclined to one side but formed in a uniform vertical direction.

In addition, in the present invention, since the dry coils are formed between levels of the clean rooms, more clean rooms can be secured as compared with the configuration where the dry coils are disposed at the sides and the central portion of the related art clean room system.

As so far described, the clean room system for a semiconductor device or a liquid crystal display device that requires a clean fabrication space in accordance with the present invention has a number of advantages. For example, since the dry coils are disposed at regular intervals between the levels of the clean rooms to allow the air stream to pass therethrough, the air stream flow in the clean rooms can be uniformly maintained. In comparison, in the related art clean room system, since the air stream inside the clean room is discharged to the side of the lower space of the clean room, the air stream is inclined and thus cleanliness at the central portion of the clean room is not maintained. In addition, because the air stream flow passages are disposed at regular intervals between levels of the clean rooms, the air stream inside the clean room can flow uniformly in a certain direction, thereby enabling the interior of the clean room to be maintained clean.

It will be apparent to those skilled in the art that various modifications and variations can be made in the clean room system of the present invention without departing from the spirit or scope of the invention. Thus, it is intended that the present invention cover the modifications and variations of this invention provided they come within the scope of the appended claims and their equivalents.

What is claimed is:

1. A clean room system, comprising:

a plurality of multi-level clean rooms having at least a lower clean room and an upper clean room disposed above the lower clean room, each clean room including a working space; and an air passage disposed to permit air flow between the upper clean room and the lower clean room and smoothing the air flow.

2. The clean room system according to claim 1, further comprising:

a fan filter unit disposed at the ceiling of the lower clean room to facilitate the air to flow from the upper clean room to the lower clean room to generate a substantially vertical air stream; and a bottom plate having a plurality of through holes.

3. The clean room system according to claim 2, wherein the fan filter unit includes:

a fan rotated to draw in air from the upper clean room; and a filter to filter particles from the air flowing through the fan filter unit.

4. The clean room system according to claim 1, wherein the air passage includes:

a lower space provided at a lower portion of the upper clean room;

an upper space provided at an upper portion of the lower clean room; and a dry coil provided between the lower space and the upper space and at an interlayer boundary plate discriminating levels.

5. The clean room system according to claim 4, wherein at least two dry coils are provided.

6. The clean room system according to claim 4, wherein the dry coils are disposed at regular intervals.

7. The clean room system according to claim 4, wherein the dry coil controls temperature and humidity of the air flowing between the upper and lower clean rooms.

8. The clean room system according to claim 1, wherein the air passage includes:

a lower space provided at a lower portion of the upper clean room;

an upper space provided at an upper portion of the lower clean room; and a plurality of holes provide between the lower space and the upper space and at an interlayer boundary plate discriminating levels.

9. The clean room system according to claim 1, further comprising a connection pipe for moving the air discharged from a lower space of a lowermost one of the plurality of multi-level clean rooms to a upper space of an uppermost one of the plurality of multi-level clean rooms.

10. The clean room system according to claim 1, further comprising an exhaust pipe to externally discharge an air stream from the lower space of a lowermost one of the plurality of multi-level clean rooms.

11. A clean room system, comprising:

a plurality of multi-level clean rooms having at least a lower clean room and an upper clean room disposed above the lower clean room, each clean room having a working space, an upper space and a lower space at upper and lower portions thereof;

at least one interlayer boundary plate formed between the lower space of the upper clean room and an upper space of the lower clean room; and a plurality of dry coils formed substantially at the interlayer boundary plate and to provide a passage through which air can flow from the lower space of the upper level clean room to the upper space of the lower level clean room.

12. The clean room system according to claim 11, further comprising a fan filter unit disposed substantially at the ceiling of the working space of the lower clean room to facilitate air to flow from the upper clean room to the lower clean room.

13. The clean room system according to claim 12, wherein the fan filter unit includes:

a fan rotated to draw in air from the upper clean room; and a filter to filter particles from air flowing through the fan filter unit.

14. The clean room system according to claim 11, further comprising a connection pipe for moving the air discharged from a lower space of a lowermost one of the plurality of multi-level clean rooms to a upper space of an uppermost one of the plurality of multi-level clean rooms.

15. The clean room system according to claim 11, further comprising an exhaust pipe to externally discharge an air stream from the lower space of a lowermost one of the plurality of multi-level clean rooms.

16. The clean room system according to claim 11, wherein each dry coil controls a temperature and a humidity of the air stream.

17. A clean room system, comprising:

a lower clean room of multi-level clean rooms, the lower clean room having upper and lower spaces respectively above and below a working space of the lower clean room;

an upper clean room of multi-level clean rooms disposed above the lower clean room, the upper clean room having upper and lower spaces respectively above and below a working space of the upper clean room;

an interlayer boundary plate disposed between the lower space of the upper clean room and an upper space of the lower level clean room; and a plurality of holes formed at the interlayer boundary plate to provide a passage through which air can flow from the lower pace of the upper level clean room to the upper space of the lower level clean room.

18. The clean room system according to claim 17, further comprising a fan filter unit disposed substantially at the ceiling of the working space of the lower clean room to facilitate air to flow from the upper clean room to the lower clean room and to filter particles from the air flowing from the upper clean room to the lower clean room.

19. The clean room system according to claim 18, wherein a plurality of fan filter units are disposed substantially at the ceiling of the working space of the lower clean room.

20. The clean room system according to claim 17, further comprising a connection pipe for moving the air discharged from a lower space of a lowermost one of the plurality of multi-level clean room to a upper space of an uppermost one of the plurality of multi-level clean rooms.

21. The clean room system according to claim 17, further comprising an exhaust pipe to externally discharge an air stream from the lower space of a lowermost one of the plurality of multi-level clean rooms.

22. The clean room system according to claim 1, wherein each clean room further includes an upper space disposed above the respective working space and a lower space disposed below the respective working space.

23. The clean room system according to claim 22, wherein each clean room further includes a floor structure disposed separating the lower space and the working space, and a ceiling structure disposed separating the working space and the upper space.

24. The clean room system according to claim 1, wherein each clean room further includes a lower space disposed below the respective working space.

25. The clean room system according to claim 24, wherein each clean room further includes bottom plate disposed separating the lower space and the working space.

26. The clean room system according to claim 1, wherein each clean room further includes an upper space disposed above the respective working space.

27. The clean room system according to claim 25, wherein each clean room further includes a fan filter unit disposed separating the working space and the upper space.

* * * * *